United States Patent [19]

Schnell

[11] 4,129,002

[45] * Dec. 12, 1978

[54] CYLINDER PIECE FOR A PILE DRIVING RAM

[75] Inventor: Hans G. Schnell, Hamburg, Fed. Rep. of Germany

[73] Assignee: Van Kooten B.V., Naarden, Netherlands

[ * ] Notice: The portion of the term of this patent subsequent to Jan. 10, 1995, has been disclaimed.

[21] Appl. No.: 629,917

[22] Filed: Nov. 7, 1975

[30] Foreign Application Priority Data

Nov. 20, 1974 [NL] Netherlands ..... 7415152

[51] Int. Cl.[2] ..... F01B 29/08; B22D 13/02

[52] U.S. Cl. ..... 60/633; 123/193 C; 173/137; 164/114; 164/286; 164/DIG. 3

[58] Field of Search ..... 60/633; 123/193 C; 173/137; 164/114, 286, DIG. 3

[56] References Cited

U.S. PATENT DOCUMENTS

| | | | |
|---|---|---|---|
| 3,242,997 | 3/1966 | Tokola | 173/131 |
| 3,455,208 | 7/1969 | Adams et al. | 91/352 |
| 3,615,879 | 10/1971 | Herzog | 164/286 |

OTHER PUBLICATIONS

De Bruijn et al, "Industrial Data Mechanical Engineering," 1966; p. 40.

Young, E. M., "Diesel Powered Pile Hammers," Engineering News-Record, May 15, 1958, pp. 54–62.

Rand, M. R., "Diesel Pile Hammer," Roads & Streets, May, 1961, pp. 132–134.

Donoho, C. K., "Centrifugally Cast Steel," Iron Age, Apr. 1, 1943, pp. 52–58.

McKiernan-Terry Pile Hammers, Bulletin 67, Aug. 8, 1958.

*Primary Examiner*—Robert E. Garrett

*Attorney, Agent, or Firm*—Lewis H. Eslinger

[57] ABSTRACT

A pile driving ram for driving piles into subaqueous ground, during which a heavy piston operating as a hammer is each time lifted by fuel explosion in a cylinder, comprises a considerable and expensive cylinder piece, which has inlet and outlet ports and which comprises at least two guide girdles for supporting guide members co-operating with at least one guide stay of a guide frame. In order to increase the lifetime of the cylinder piece, the core is moulded from precious steel according to the fling moulding method.

22 Claims, 12 Drawing Figures

Figure 1:
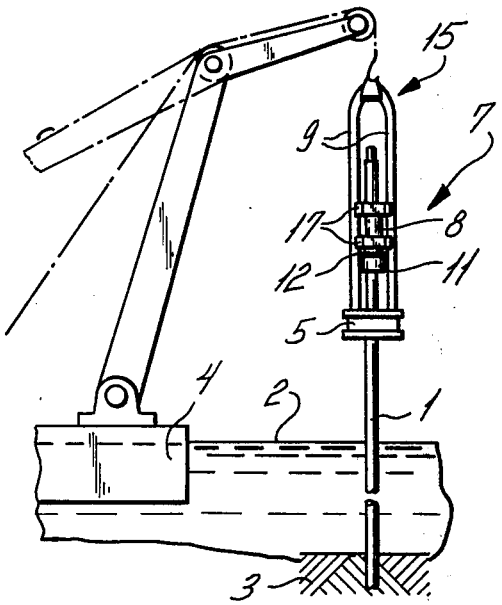

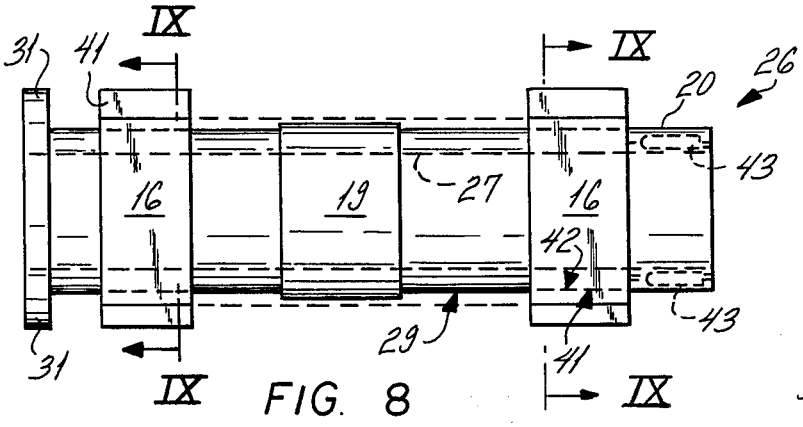
FIG. 8
FIG. 9
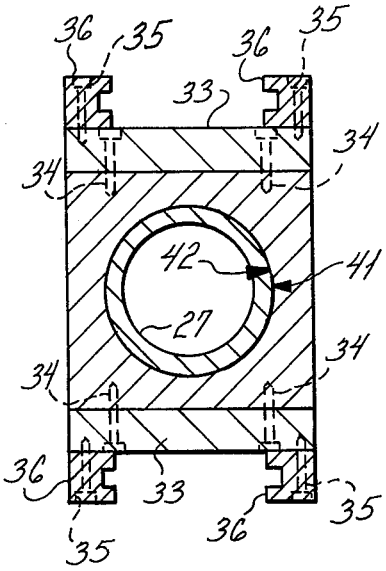
FIG. 10
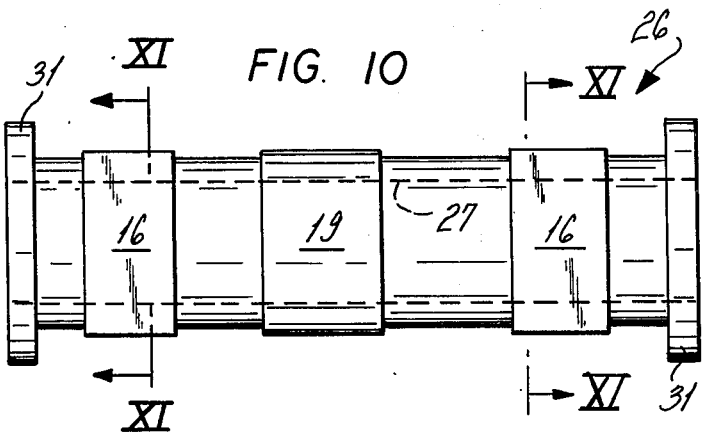
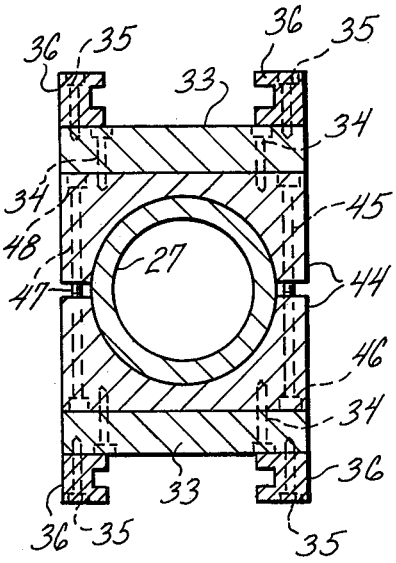
FIG. 11
FIG. 12
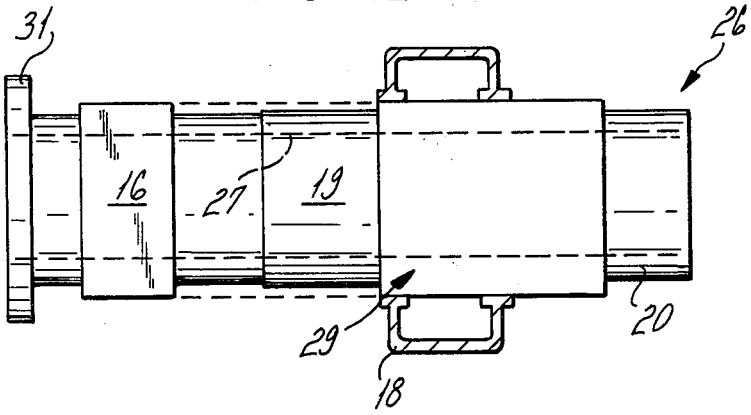

CYLINDER PIECE FOR A PILE DRIVING RAM

The invention relates to a cylinder piece for the cylinder of a pile driving ram, said cylinder having inlet and outlet ports and at least two guide girdles for supporting guide members co-operating with at least one guiding stay of a guiding frame.

Such a cylinder piece is known and is employed particularly in a ram for driving piles into subaqueous ground, during which a heavy piston operating as a hammer is each time lifted by fuel explosion in a cylinder, part of which is formed by said cylinder piece. Such a cylinder piece is bulky; it may have a diameter of 0.5 or even 1 meter and a length of, for example, 6 meters, so that it is very expensive. The known cylinder piece may either be cast from modular cast iron or be built up from parts united by welding. The mechanical load of the cylinder piece, also due to the usually rough handling in pile driving, is very high and hence the life-time of the known cylinder pieces is short. It may occur that during the driving operation the cylinder piece is unexpectedly broken up so that the job is seriously delayed.

The invention has for its object to provide a cylinder piece of the kind set forth above, which reduces the possibility of unexpected damage and which has a long lifetime. To this end at least the core of the cylinder piece according to the invention is made by moulding it from precious steel according to the fling moulding method.

The core is preferably moulded according to the fling moulding method with at least two substantially cylindrical guide girdle faces for guide girdles. This core can be readily prepared in the manner described, whilst the guide girdles can be firmly arranged in place without difficulty. For this purpose each guide girdle may be formed substantially by a ring having a cylindrical bore and shrunk around a guide girdle face or, as an alternative each guide girdle may be divided in an axial direction and be clamped by the clamping means around a guide girdle face.

If each guide girdle has a substantially square or rectangular circumference, the guide members can be readily secured firmly around the guide girdles.

If the core is moulded with at least one substantially cylindrical tank girdle face for supporting an annular tank, the tank for holding fuel can be simply fastened thereto, for example, by shrinking or by dividing the tank in an axial direction and arranging the same around the tank girdle face.

If the outer diameter of each guide girdle face exceeds the outer diameter of an annular port girdle having inlet and outlet ports and that of at least one of the two ends of the cylinder piece the shrinking method may be employed for fastening the guide girdles.

The precious steel may, particularly be 25 $CrMo_4$ or 32 $CrMo_{12}$ and more particularly 34 $CrMo_4$ or 42 $CrMo_4$.

The invention will be described more fully hereinafter with reference to a drawing.

Figure 2:
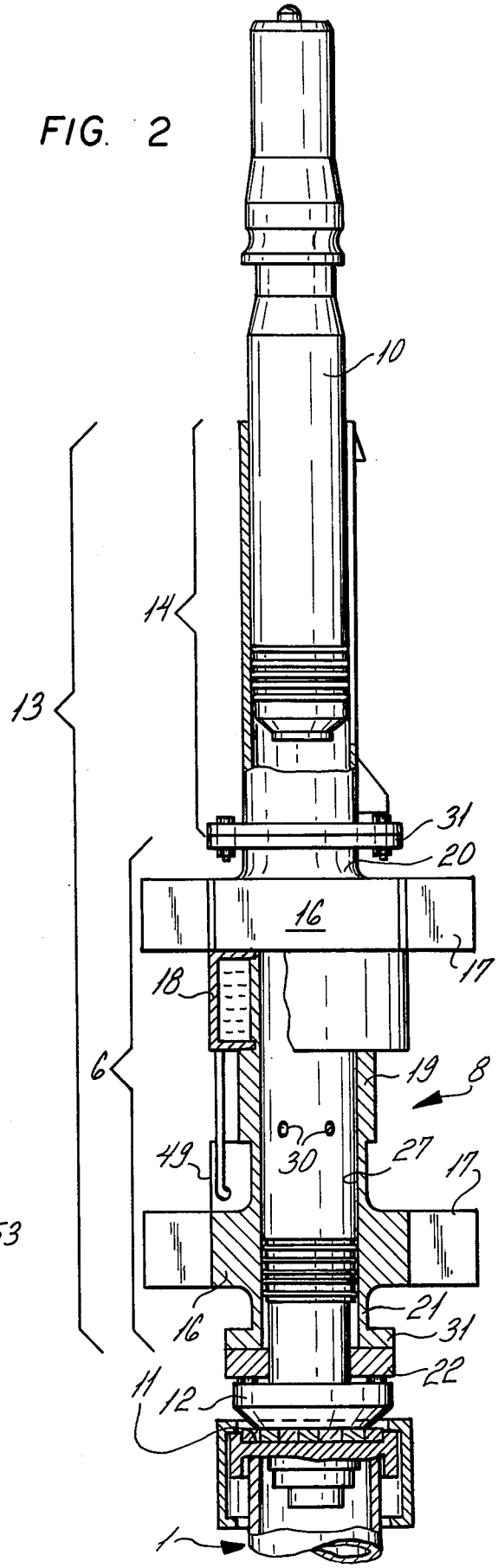
Figure 3:
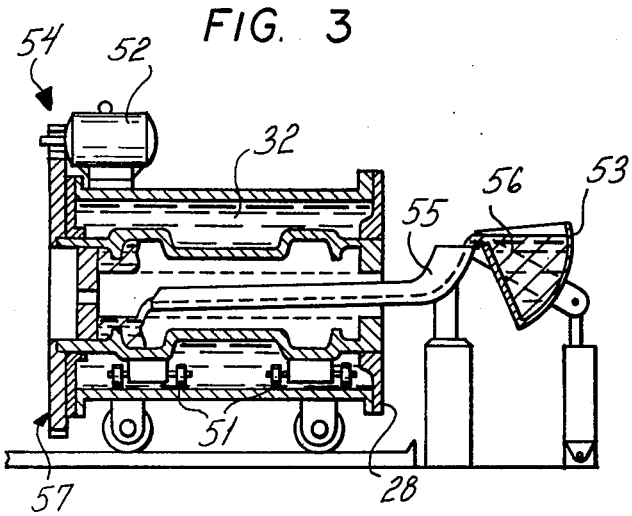
Figure 4:
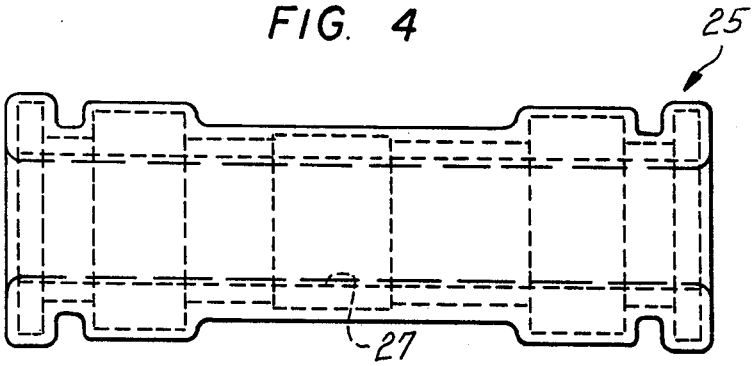
Figure 5:
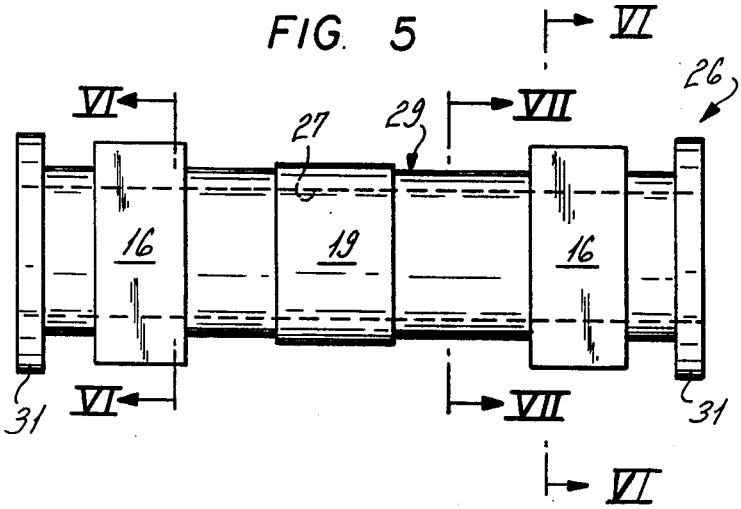
Figure 6:
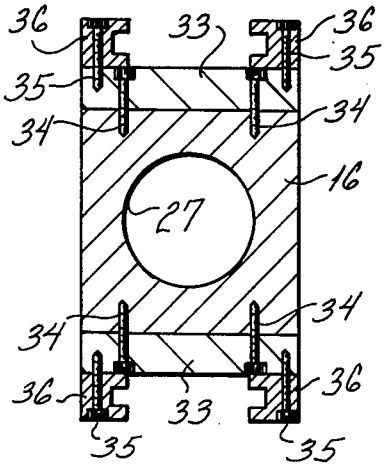
Figure 7:
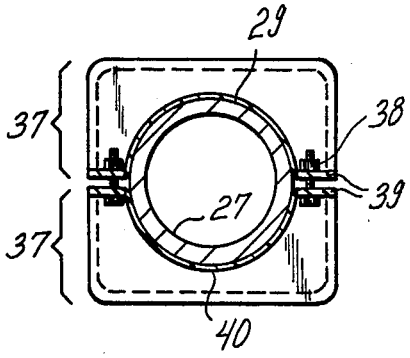

In the drawing:

FIG. 1 is a schematic survey of the operation of a pile driving system equipped with a cylinder piece in accordance with the invention, FIG. 2 is an enlarged vertical sectional view of the cylinder piece of FIG. 1 bearing on a pile, FIG. 3 shows a moulding device for the preparation of a moulded piece for a cylinder piece in accordance with the invention, FIG. 4 shows a moulded piece for a cylinder piece in accordance with the invention, FIG. 5 shows a cylinder piece made from the moulded piece of FIG. 4 in accordance with the invention, FIG. 6 is a sectional view taken on the lines VI—VI in FIG. 5 in the mounted state of the cylinder piece, FIG. 7 is a sectional view taken on the line VII—VII in FIG. 5 in the mounted state of the cylinder piece, FIGS. 8, 10 and 12 are elevational views corresponding with FIG. 5 of individually different cylinder pieces in accordance with the invention, FIG. 9 is a sectional view taken on the lines IX—IX in FIG. 8 in the mounted state of the cylinder piece, and FIG. 11 is a sectional view taken on the lines XI—XI in FIG. 10 in the mounted state of the cylinder piece.

By means of a floating derrick 4 a pile driving device 7 is arranged on a pile 1 to be driven in a ground 3 beneath the water 2. This pile driving device 7 comprises a guide frame 15 comprising a foot 5 engaged around the pile 1 and two guide stays 9 secured thereto. The device 7 comprises furthermore a ram 8 guided along the guide stays 9 by means of guide members 17 and a driving head 11 bearing on the pile 1.

FIG. 2 shows that the ram 8 comprises a cylinder 13 having a top portion 14 and a cylinder piece 6 in accordance with the invention. In the cylinder 13 are guided a piston 10 operating like a hammer and an impact member 12 bearing on the driving head 11.

The cylinder piece 6 comprises two guide girdles 16 for supporting the guide members 17 and supports an annular tank 18. Moreover the cylinder piece 6 has a port girdle 19 having ports 30 for admitting air and expelling exhaust gases. At the top end the cylinder piece 6 has a connecting rim 20, to which the top portion 14 is secured by bolts and at the lower end it has a connecting rim 21 for a bottom ring 22 of the cylinder piece 6.

For manufacturing a core 26 of the cylinder piece 6 first a tubular moulded piece 25 is moulded from precious steel by means of the fling moulding device 54 of FIG. 3. The fling moulding device 54 comprises a wagon 28 having a cooling reservoir 32 in which a divided mould is rotatably beared on rollers 51. The mould is driven by means of a motor 52 and a driving gear 57. The precious steel 56 is moulded from a pan 53 through a gutter 55 into the rotating mould. After the moulded piece 25 has assumed the required shape of FIG. 4, the required heat treatments are applied in order to reduce the material stress produced in cooling and to obtain the maximum quality of the kind of steel concerned. The moulded piece 25 may, for example, be made from one of the following precious steels according to DIN 17 200/12.69:

breaking stress 0.2 yield value

| kind of steel | δ B kp/mm² | δn 0.2 kp/mm² | δ % elasticity | carbon % |
|---|---|---|---|---|
| 25 $CrMo_4$ | 80–95 | 60 | 14 | 0.22–0.29 |
| 34 $CrMo_4$ | 90–110 | 68 | 12 | 0.30–0.37 |
| 42 $CrMo_4$ | 100–120 | 78 | 11 | 0.38–0.45 |
| 32 $CrMo_{12}$ | 125–145 | 105 | 9 | 0.28–0.35 |

| kind of steel | manganese | chromium | molybdenum |
|---|---|---|---|
| 25 $CrMo_4$ | 0.5–0.8 Mn | 0.9–1.2 Cr | 0.15–0.3 Mo |

-continued

| | | | |
|---|---|---|---|
| 34 $CrMo_4$ | 0.5–0.8 Mn | 0.9–1.2 Cr | 0.15–0.3 Mo |
| 42 $CrMo_4$ | 0.5–0.8 Mn | 0.9–1.2 Cr | 0.15–0.3 Mo |
| 32 $CrMo_{12}$ | 0.4–0.7 Mn | 2.8–3.3 Cr | 0.3 –0.5 Mo |

Each of these kinds of steel contains 0.15 to 0.4 silicon, 0.035 phosphorus and 0.035 sulfur. It is preferred to use the kinds of steel 34 $CrMo_4$ and 42 $CrMo_4$.

The moulded piece 25 is turned off into the shape of the core shown in FIG. 5 at 26 and indicated in FIG. 4 by broken lines. The core 26 has a cylindrical bore 27, two moulded guide girdles 16 of square circumference, a cylindrical tank girdle face 29, a moulded port girdle 19 and two moulded flanges 31 for securing the cylinder piece 6 to the top portion 14 and to the bottom ring 22 (see FIG. 2). The square guide girdles 16 are obtained by removing segments in a turning off operation. The guide girdles 16 support each two spacer members 33 fastened thereto by means of countersunk bolts 34 and guide members 36 secured thereto by countersunk bolts 35 and having a U-shaped section.

The tank 18 is axially divided into halves 37, which are clamped together around the cylindrical tank girdle face 29 by means of clamping bolts 38 engaging flanges 39. Between the flanges 39 and around the tank girdle face 29 sealing strips 40, for example, of teflon, are provided. If desired, the tank 18 may be divided axially into more than two parts.

The port girdle 19 has inlet and outlet ports 30 for admitting fresh combustion air and expelling exhaust gases.

The core 26 of FIG. 8 differs from that of FIG. 5 in that each guide girdle 16 comprises a steel ring with a bore 42, which is shrunk around a moulded, cylindrical guide girdle face 41 (see FIG. 9). One connecting rim 20 does not exhibit the shape of a flange, but it is formed by a thick wall with axial bores 43 for bolts. In order to allow homing of the guide girdles 16 the diameter of the bore of the hot guide girdle 16 is larger than that of the port girdle 19, the guide girdle faces 41 and the connecting rim 20. In order to facilitate slipping on the outer diameter of each guide girdle face is preferably larger than the outer diameter of the port girdle 19 and the connecting rim 20 and larger than the outer diameter of the connecting rim 20.

The core 26 of FIGS. 10 and 11 differs from that of FIG. 8 in that the guide girdles 16 are each divided in an axial direction into guide girdle halves 44, which are clamped around a guide girdle face 41 by means of clamping bolts 45 and nuts 46. The clamping bolts 45 are countersunk.

The core 26 of FIG. 12 differs from that of FIG. 8 only in that it is provided with a tank girdle face 29 having the same diameter as the guide girdle faces 41. An annular tank 18 can be shrunk onto this tank girdle face 29.

It should be noted that the tank 18 need not necessarily be secured to the cylinder piece 6. As an alternative, a fuel pump 49 fastened to the ram 8 may be fed through a hose (not shown) from a fuel tank (not shown) arranged, for example, on board the derrick 4.

Preferably also the top portion 14 of the cylinder piece 16 is moulded from precious steel according to the fling moulding process.

What we claim is:

1. In a pile driving device comprising a guide frame having guide stays and a foot for receiving a pile to be driven; a cylinder having interconnected an upper portion and a lower portion; a piston slidable in said cylinder; guide members connected to said cylinder and engaging said guide stays; an impact member slidable in said cylinder; and a bottom ring connected to the lower portion, said bottom ring slidably receiving the impact member; the improvement which comprises said lower portion of said cylinder being a centrifugally cast alloy steel having end portions adapted to be connected to the upper portion of said cylinder and to the bottom ring, inlet and outlet ports between said end portions, and a plurality of guide girdles for supporting said guide members.

2. A pile driving device as claimed in claim 1, wherein the lower portion of said cylinder is cast with at least two substantially cylindrical guide girdle faces for guide girdles.

3. A pile driving device as claimed in claim 2, wherein the core is cast with at least two substantially cylindrical guide girdle faces for guide girdles and wherein each guide girdle is mainly formed by a ring with a cylindrical bore shrunk around a guide girdle face.

4. A pile driving device as claimed in claim 2, wherein the lower portion of said cylinder is cast with at least two substantially cylindrical guide girdle faces for guide girdles and wherein each guide girdle is divided in an axial direction and is clamped around a guide girdle face by clamping means.

5. A pile driving device as claimed in claim 1, wherein each guide girdle of the lower portion of said cylinder has a substantially square or rectangular circumference.

6. A pile driving device as claimed in claim 1, wherein the lower portion of said cylinder is cast with at least one mainly cylindrical tank girdle face for supporting an annular tank.

7. A pile driving device as claimed in claim 1, wherein the lower portion of said cylinder is cast with at least one mainly cylindrical tank girdle face for supporting an annular tank and wherein the tank is shrunk around the tank girdle face.

8. A pile driving device as claimed in claim 1, wherein the lower portion of said cylinder is cast with at least one mainly cylindrical tank girdle face for supporting an annular tank and wherein the tank is divided in an axial direction and is arranged around the tank girdle face.

9. A pile driving device as claimed in claim 1, wherein the outer diameter of each guide girdle of the lower portion of said cylinder is larger than the outer diameter of an annular port girdle for the inlet and outlet ports and larger than that of at least one of the two ends of the lower portion of said cylinder.

10. A pile driving device as claimed in claim 1, wherein the lower portion of said cylinder is cast from stainless steel.

11. A pile driving device as claimed in claim 1, wherein the lower portion of said cylinder is forged from stainless steel whose properties substantially correspond with those of 25 $CrMo_4$ or 32 $CrMo_4$.

12. A pile driving device as claimed in claim 1, wherein the lower portion of said cylinder is cast from stainless steel whose properties substantially correspond with those of 34 $CrMo_4$ or $CrMo_4$.

13. A pile driving device as claimed in claim 1, wherein the lower portion of said cylinder has cast to it at least two guide girdles each having a substantially rectangular or square circumference.

14. A cylinder piece for the cylinder of a pile driving ram, said cylinder being provided with inlet and outlet ports and at least two guide girdles for supporting guide members adapted to cooperate with at least one guide stay of a girdle frame, wherein at least the core of the cylinder piece is made by centrifugal casting and is molded with at least two substantially cylindrical guide girdle faces for guide girdles, with each guide girdle being mainly formed by a ring with a cylindrical bore shrunk around a guide girdle face.

15. A cylinder piece as claimed in claim 14, wherein the core is cast from precious steel, whose properties substantially correspond with those of 25 $CrMo_4$ or 32 $CrMo_{12}$.

16. A cylinder piece as claimed in claim 14, wherein the core is cast from precious steel, whose properties substantially correspond with those of 34 $CrMo_4$ or 42 $CrMo_4$.

17. A cylinder piece as claimed in claim 14, wherein the core has cast at least two guide girdles each having a substantially round circumference, said guide girdles then obtaining a rectangular or square circumference in a turning off operation.

18. A cylinder piece for the cylinder of a pile driving ram, said cylinder being provided with inlet and outlet ports and at least two guide girdles for supporting guide members adapted to cooperate with at least one guide stay of a guide frame, wherein at least the core of the cylinder piece is made by centrifugal casting and is moulded with at least two substantially cylindrical guide girdle faces for guide girdles, with each guide girdle being divided in an axial direction and clamped around a guide girdle face by clamping means.

19. A cylinder piece for the cylinder of a pile driving ram, said cylinder being provided with inlet and outlet ports and at least two guide girdles for supporting guide members adapted to cooperate with at least one guide stay of a guide frame, wherein at least the core of the cylinder piece is made by centrifugal casting and each guide girdle has a substantially square or rectangular circumference.

20. A cylinder piece for the cylinder of a pile driving ram, said cylinder being provided with inlet and outlet ports and at least two guide girdles for supporting guide members adapted to cooperate with at least one guide stay of a guide frame, wherein at least the core of the cylinder piece is made by centrifugal casting and is cast with at least one mainly cylindrical tank girdle face for supporting an annular tank, with the tank being shrunk around the tank girdle face.

21. A cylinder piece for the cylinder of a pile driving ram, said cylinder being provided with inlet and outlet ports and at least two guide girdles for supporting guide members adapted to cooperate with at least one guide stay of a guide frame, wherein at least the core of the cylinder piece is made by centrifugal casting and is cast with at least one mainly cylindrical tank girdle face for supporting an annular tank, with the tank being divided in an axial direction and arranged around the tank girdle face.

22. A cylinder piece for the cylinder of a pile driving ram, said cylinder being provided with inlet and outlet ports and at least two guide girdles for supporting guide members adapted to cooperate with at least one guide stay of a guide frame, wherein at least the core of the cylinder piece is made by centrifugal casting and the outer diameter of each guide girdle face being larger than the outer diameter of an annular port girdle for the inlet and outlet ports and larger than that of at least one of the two ends of the cylinder piece.

* * * * *